US011292558B2

(12) United States Patent
Zhou

(10) Patent No.: US 11,292,558 B2
(45) Date of Patent: Apr. 5, 2022

(54) CHEST FLOAT

(71) Applicant: Zhejiang Mambobaby Baby Products Co., Ltd., Yiwu (CN)

(72) Inventor: Weixin Zhou, Jinhua (CN)

( * ) Notice: Subject to any disclaimer, the term of this patent is extended or adjusted under 35 U.S.C. 154(b) by 0 days.

(21) Appl. No.: 16/920,453

(22) Filed: Jul. 3, 2020

(65) Prior Publication Data

US 2020/0331569 A1 Oct. 22, 2020

(30) Foreign Application Priority Data

Sep. 30, 2019 (CN) ..... 201921653033.0

(51) Int. Cl.
*B63B 34/50* (2020.01)
*A63B 31/00* (2006.01)

(52) U.S. Cl.
CPC ..... *B63B 34/50* (2020.02); *A63B 31/00* (2013.01)

(58) Field of Classification Search
CPC ..... B63B 34/00; A63B 31/00; B63C 9/115
See application file for complete search history.

(56) References Cited

U.S. PATENT DOCUMENTS

| | | | | |
|---|---|---|---|---|
| 6,354,295 | B1 * | 3/2002 | Hasson, Jr. | A62B 25/00 128/201.27 |
| 6,786,786 | B1 * | 9/2004 | Davis | B63C 9/135 441/120 |
| 10,793,235 | B2 * | 10/2020 | Zhou | B63B 34/50 |
| 2004/0058598 | A1 * | 3/2004 | Miller | B63C 9/115 441/115 |
| 2012/0015571 | A1 * | 1/2012 | Warmuth-Rued | A63B 69/12 441/129 |
| 2015/0307171 | A1 * | 10/2015 | Maechler | B63C 9/115 441/106 |
| 2020/0331569 | A1 * | 10/2020 | Zhou | A63B 31/00 |

* cited by examiner

*Primary Examiner* — Lars A Olson
*Assistant Examiner* — Jovon E Hayes

(57) ABSTRACT

The present invention relates to a chest float, comprising a float body; and a support pad, wherein both sides thereof are in detachable connection with both sides of the inner edge of the float body; first and second back limit pads are respectively extended from the two sides of the support pad, the first and second back limit pads are in detachable connection, and a wrapping space is enclosed by the support pad, and first and second back limit pads; when support pad is demounted from the inner edge of the float body from the two sides, the use state of the chest float is switched to the use state of a waist float. By means of the detachable design of the support pad, the chest float realizes the switching between the lying prone state and standing state of an infant, and is adapted to infants of different ages.

10 Claims, 2 Drawing Sheets

CHEST FLOAT

TECHNICAL FIELD

The present invention belongs to the technical field of articles for swimming, and in particular relates to a chest float.

BACKGROUND

Swimming can effectively promote the development of the brain and nervous system of infants, stimulate the potential of infants, and lay a good foundation for improving infant's EQ and IQ; can also enhance myocardial function, enhance resistance and strengthen lung function. For infants, swimming chest floats are indispensable swimming aids.

As infants grow older, based on their curiosity about things, they are not limited to swimming in a lying prone posture during swimming, but are more inclined to control themselves and prefer swimming in a standing posture. Due to the design of the existing swimming chest floats, infants can only swim in a posture of lying prone on chest floats; with the increase of age, infants are more inclined to swim in a standing state, so the existing chest floats are obviously not applicable.

Therefore, there is an urgent need to design a novel chest float.

SUMMARY

In view of the defects existing in the prior art, the present invention provide a chest float.

To achieve the above purpose, the present invention adopts the following technical solution:

a chest float, comprising:

a float body, and a support pad located at an inner edge of the float body, wherein both sides thereof are in detachable connection with both sides of the inner edge of the float body;

a first back limit pad and a second back limit pad are respectively extended from the two sides of the support pad, the first back limit pad and the second back limit pad are in detachable connection, and a wrapping space is enclosed by the support pad, the first back limit pad and the second back limit pad; and when the support pad is demounted from the inner edge of the float body from the two sides, the use state of the chest float is switched to the use state of a waist float.

As a preferred solution, the detachable connection between the two sides of the support pad and the inner edge of the float body is zipper connection, velcro connection or button connection.

As a preferred solution, a floating block is detachably mounted at the tail of the float body.

As a preferred solution, an opening is provided at the tail of the float body.

As a preferred solution, the opening of the float body is connected by a detachable connecting piece.

As a preferred solution, the detachable connecting piece is a buckle, button or velcro.

As a preferred solution, the front part of the support pad is connected to the inner edge of the float body, to form a chest protecting part.

As a preferred solution, the float body is provided with a lock catch and adjustable shoulder belts, and the inserting end of each of the adjustable shoulder belts is inserted into or separated from the lock catch.

As a preferred solution, the first back limit pad is provided with a first protective belt, the second back limit pad is with a second protective belt, and the inserting ends of the first protective belt and the second protective belt are inserted into or separated from the lock catch respectively.

As a preferred solution, the tail of the support part is detachably connected with a crotch part, and the inserting end of the crotch part is inserted into or separated from the lock catch.

As a preferred solution, the float body is provided with a headrest.

Compared with the prior art, the present invention has the following advantageous effects:

I. By means of the detachable design of the support pad, the chest float of the present invention can be converted into a waist float, realizes the switching between lying prone state and standing sate of an infant, and is adapted to infants of different ages.

II. By arranging the floating block, the buoyancy at the tail of the chest float is increased, and the risk of backward rolling-over of the infant during swimming is further prevented.

DETAILED DESCRIPTION

To more clearly describe embodiments of the present invention, specific embodiments of the present invention are further described below in combination with accompanying drawings. Apparently, the drawings in the following description are merely some embodiments of the present invention, and for those ordinary skilled in the art, other drawings can also be obtained according to the drawings without contributing creative labor, and other embodiments can be obtained. In addition, the directional terms such as "upper", "lower", "left", "right", "front" or "back" mentioned in the following embodiments are used for convenience in referring to the accompanying drawings. Therefore, the used terms are only used for illustrating the present invention, not used for limiting the present invention.

Embodiment 1

Figure 1:
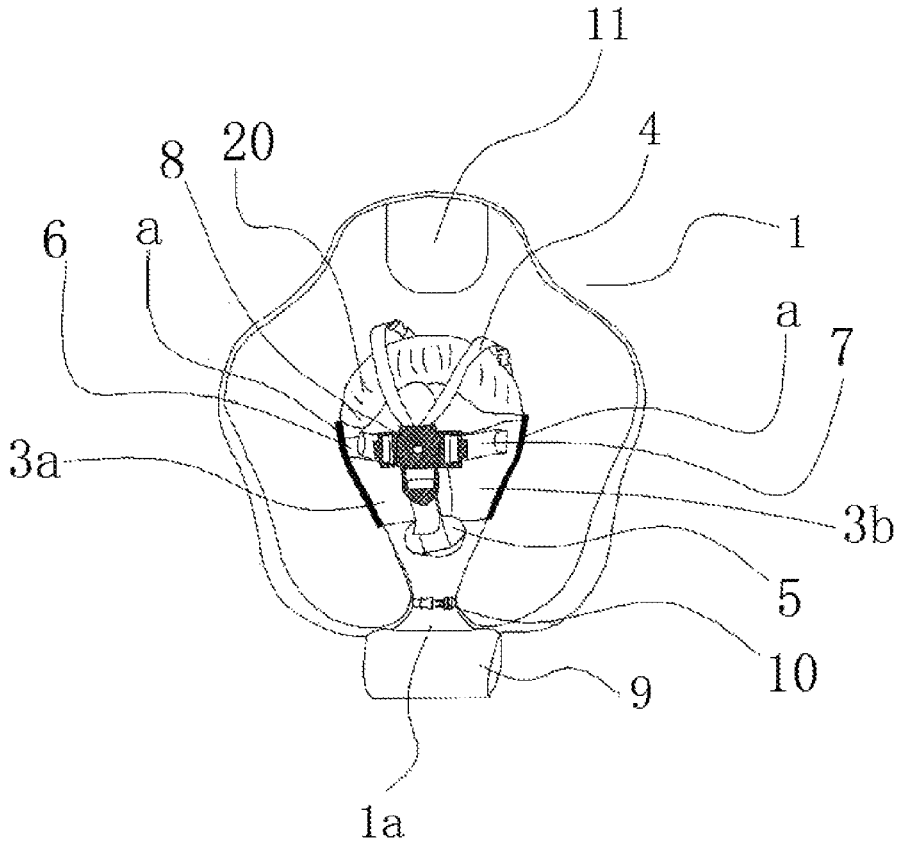
FIG. 1 is a structural schematic diagram of the chest float in embodiment 1 of the present invention.
Figure 2:
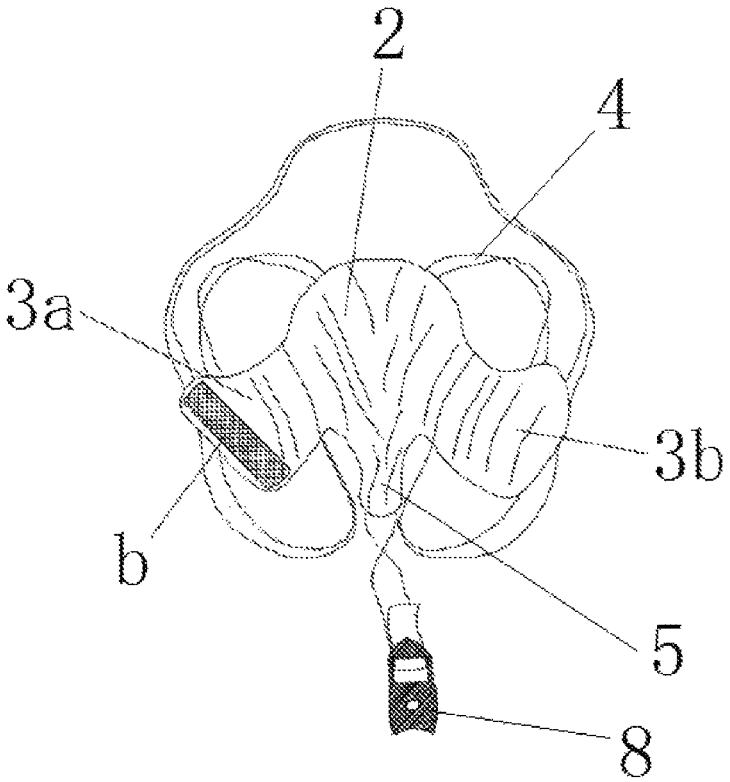
FIG. 2 is a structural schematic diagram of the chest float in embodiment 1 of the present invention in another state (the structure of the part not shown).

As shown in FIG. 1 and FIG. 2, the chest float in this embodiment, comprising a float body 1, a support pad 2, a first back limit pad 3*a*, and a second back limit pad 3*b*.

Specifically, an opening 1*a* is provided at the tail of the float body 1; the float body comprises a liner and an outer sleeve, wherein the liner is made of microcapsule foam material, does not need to be inflated, and has high safety; the surface of the outer sleeve is provided with a skin-friendly layer, thus having high comfort; the opening 1*a* of the float body is provided at the tail of the float body, to facilitate the feet of an infant to stretch out, so that the infant is in a lying prone state, and the comfort is improved. The whole float body 1 is of an axisymmetric structure, ensuring the stability of swimming.

The support pad 2 is located at an inner edge of the float body 1, both sides thereof are in detachable connection with both sides of the inner edge of the float body, the detachable connection is preferably zipper a connection, and other existing detachable connection modes such as velcro connection or button connection and the like can also be adopted. When the two sides of the support pad 2 are connected to the inner edge of the float body, the support pad is used to support the abdomen of the infant who is in a lying prone state, so that the infant can lie prone on the float body comfortably; when the support pad 2 is demounted from the inner edge of the float body from the two sides, the support of the support pad 2 on the abdomen of the infant who is in a lying prone state is released, at this moment, the lying prone state of the infant is converted into a standing state, that is, the use state of the chest float is switched to the use state of a waist float, so as to be adapted to infants of different ages. Wherein, the front part of the support pad 2 is fixedly connected to the front part of the inner edge of the float body, to form a chest protecting part 20, so as to protect the chest and abdomen of the infant, improve the comfort of the infant, and prevent the two sides of the support pad from being separated from the float body in a dismounted state, avoiding the trouble of losing after separation.

A first back limit pad 3*a* and a second back limit pad 3*b* are respectively extended from the left and right sides of the support pad 2 in this embodiment, the first back limit pad 3*a* and the second back limit pad 3*b* are in detachable connection, and a wrapping space is enclosed by the support pad 2, the first back limit pad 3*a* and the second back limit pad 3*b*, to support the infant and limit the back, and improve the safety of the infant. Specifically, the first back limit pad 3*a* and the second back limit pad 3*b* are symmetrical to each other. The first back limit pad 3*a* and the second back limit pad 3*b* are preferably connected by a Velcro b to facilitate the connection or disconnection of the first back limit pad 3*a* and the second back limit pad 3*b*, or may be connected in other existing detachable connection modes, for example, buckle connection, button connection and the like. Wherein, the support pad 2, the first back limit pad 3*a* and the second back limit pad 3*b* are integrated in one piece.

In order to improve the safety of swimming, adjustable shoulder belts 4 are also mounted on the left and right sides of the float body 1. As shown in FIG. 2, a crotch part 5 is detachably mounted at the tail of the support part 2, the crotch part 5 is used for supporting the crotch of an infant, and the crotch part may be dismounted when being switched to the use state of a waist float; a first protective belt 6 extending in the direction in which the second back limit pad is located is mounted on the first back limit pad 3*a*, and has an adjustable length, for example, the adjustable length is achieved adopting the stair button design; a second protective belt 7 extending in the direction in which the first back limit pad is located is mounted on the second back limit pad 3*b*, and has an adjustable length, for example, the adjustable length is achieved adopting the stair button design; the inserting end of each of the two adjustable shoulder belts 4, the crotch part 5, the first protective belt 6 and the second protective belt 7 is provided with a plug, to be inserted into or separated from the five-point lock catch 8, so as to carry out limit protection or release limit protection for the infant in all directions. Wherein, the design of the adjustable shoulder belts can refer to the design structure of the safety belt or the design of the stair button in the prior art, as long as the length of the shoulder belts is adjustable, and will not be repeated herein.

The tail of the float body in this embodiment is connected with a floating block 9, to improve the buoyancy of the tail of the float body, and prevent the accident caused by the backward rolling-over of the float body; and the floating block may be dismounted. The connection between the floating block 9 and the float body is preferably detachable connection, for example, buckle connection, button connection and the like, and the floating block may be fixedly connected to the float body as well.

In addition, the opening 1*a* of the float body in this embodiment is connected by a connecting piece 10, the connecting piece 10 being a buckle, button or velcro, so the float body is enclosed to facilitate the conversion of the chest float to a waist float.

In addition, the front part of the float body 1 is provided with a headrest 11 used for the infant in a lying prone state to butt against by head, to facilitate the infant to rest. Wherein the design of the headrest 11 ensures that when the infant butts against the headrest, the inclination angle between the support pad and the headrest is 30-50 degrees, improving comfort.

Embodiment 2

The chest float in this embodiment is different from that in embodiment 2 in that: the front part of the support pad is in detachable connection with the front part of the inner edge of the float body, so the support pad can be completely separated, and at this moment, the chest float is completely converted into a waist float, to achieve the diversified structure of the chest float, so as to meet the needs of different users.

For other structures, refer to embodiment 1.

Embodiment 3

The chest float in this embodiment is different from that in embodiment 2 in that:

The design of the floating block can be omitted, the design of the connecting piece can be omitted, the design of the crotch part can be omitted, the design of the headrest can be omitted, the design of the chest protecting part can be omitted, and the design of the first protective belt and the second protective belt can be omitted, specifically, design can be made according to actual needs, to achieve the diversified structure of the chest float, so as to meet the needs of different users.

For other structures, refer to embodiment 1.

The above describes the preferred embodiments and principle of the present invention in detail. For those ordinary skilled in the art, changes may be made to specific embodiments in accordance with the thought provided by the present invention, and these changes shall also be considered as the protection scope of the present invention.

The invention claimed is:

1. A chest float, comprising:

a float body; and a support pad located at an inner edge of the float body, wherein both sides thereof are in detachable connection with both sides of the inner edge of the float body;

a first back limit pad and a second back limit pad are respectively extended from the two sides of the support pad, the first back limit pad and the second back limit pad are in detachable connection, and a wrapping space is enclosed by the support pad, the first back limit pad and the second back limit pad; and when the support pad is demounted from the inner edge of the float body from the two sides, the use state of the chest float is switched to the use state of a waist float.

2. The chest float according to claim 1, characterized in that the detachable connection between the two sides of the support pad and the inner edge of the float body is zipper connection, or button connection.

3. The chest float according to claim 1, characterized in that a floating block is detachably mounted at the tail of the float body.

4. The chest float according to claim 1, characterized in that an opening is provided at the tail of the float body.

5. The chest float according to claim 4, characterized in that the opening of the float body is connected by a detachable connecting piece.

6. The chest float according to claim 5, characterized in that the detachable connecting piece is a buckle or a button.

7. The chest float according to claim 1, characterized in that the front part of the support pad is connected with the inner edge of the float body, to form a chest protecting part.

8. The chest float according to claim 1, characterized in that the float body is provided with a lock catch and adjustable shoulder belts, and the inserting end of each of the adjustable shoulder belts is inserted into or separated from the lock catch.

9. The chest float according to claim 8, characterized in that the first back limit pad is provided with a first protective belt, the second back limit pad is with a second protective belt, and the inserting ends of the first protective belt and the second protective belt are inserted into or separated from the lock catch respectively.

10. The chest float according to claim 8, characterized in that the tail of the support part is detachably connected with a crotch part, and the inserting end of the crotch part is inserted into or separated from the lock catch.

* * * * *